US006122880A

United States Patent [19]

Kolb et al.

[11] Patent Number: 6,122,880

[45] Date of Patent: Sep. 26, 2000

[54] BUILDING MODULE AND BUILDING MODULE SYSTEM FOR PRODUCING FLAT CONSTRUCTION, ESPECIALLY WALLS

[75] Inventors: Josef Kolb, Seewiese 2, Kesswil, Switzerland, CH-8593; Anton Steurer, Schöneggweg 40, Goldau, Switzerland, CH-6410

[73] Assignees: Josef Kolb, Kesswil; Anton Steurer, Goldau; Pius Grüninger, Hagendorf; Walter Thommen, Trimbach, all of Switzerland

[21] Appl. No.: 09/171,325

[22] PCT Filed: Apr. 15, 1996

[86] PCT No.: PCT/CH96/00134

§ 371 Date: Dec. 10, 1998

§ 102(e) Date: Dec. 10, 1998

[87] PCT Pub. No.: WO97/39204

PCT Pub. Date: Oct. 23, 1997

[51] Int. Cl.[7] ..... E04C 1/40; E04C 2/34

[52] U.S. Cl. ..... 52/592.6; 52/592.3; 52/604; 52/783.1; 52/503; 52/426

[58] Field of Search ..... 52/592.6, 592.3, 52/604, 606, 609, 503, 424, 426, 783.1

[56] References Cited

U.S. PATENT DOCUMENTS

| | | |
|---|---|---|
| 822,559 | 6/1906 | Stidder . |
| 2,241,079 | 5/1941 | Whitten . |
| 2,285,693 | 6/1942 | Wilson . |
| 2,703,487 | 3/1955 | Ossoinack . |
| 3,788,020 | 1/1974 | Gregori . |
| 3,888,060 | 6/1975 | Haener . |
| 4,182,089 | 1/1980 | Cook . |
| 4,301,637 | 11/1981 | Anderson . |
| 4,439,967 | 4/1984 | Dielenberg . |
| 4,473,985 | 10/1984 | Hunt . |
| 4,854,103 | 8/1989 | Klym . |
| 4,896,472 | 1/1990 | Hunt . |
| 5,230,194 | 7/1993 | McClure . |
| 5,457,926 | 10/1995 | Jensen . |
| 5,575,128 | 11/1996 | Haener . |
| 5,625,989 | 5/1997 | Brubaker et al. . |
| 5,685,119 | 11/1997 | Zschoppe . |
| 5,699,640 | 12/1997 | Bourgeois et al. . |
| 5,855,102 | 1/1999 | Chang . |
| 5,896,714 | 4/1999 | Cymbala et al. . |
| 5,899,040 | 5/1999 | Cerrato . |
| 5,901,520 | 5/1999 | Abdul-Baki . |
| 5,992,102 | 11/1999 | Ozawa . |

FOREIGN PATENT DOCUMENTS

| | | | |
|---|---|---|---|
| 48006 | 11/1933 | Denmark | 52/592.6 |
| 2003174 | 7/1971 | Germany . | |
| 270480 | 11/1950 | Switzerland . | |
| 120425 | 11/1918 | United Kingdom | 52/592.6 |

*Primary Examiner*—Robert Canfield
*Attorney, Agent, or Firm*—Cohen, Pontani, Lieberman & Pavane

[57] ABSTRACT

This invention concerns a building module for producing flat construction, especially walls, which has two parallel, panel-shaped wall parts (2, 3) the exterior surfaces of which form the wall to be constructed. A module core (14) of wood connects the two wall parts (2, 3). The module core (14) has at least one module core part (5, 39, 47, 71) which runs in the longitudinal direction (X) of the building module. When an additional building module is put in plate between the wall parts (2, 3), this core (14) protrudes into this additional building module in the vertical direction (Z) and forms with these wall parts (2, 3) an interlocking connection which takes up forces in the transverse direction (Y). Means (19, 20; 77, 78) are provided for the purpose of forming an interlocking connection which takes up forces in the longitudinal direction (X) when an additional building module is put into place. Building modules with modified module cores can be stacked one on the other, making varied wall construction possible. Extensive space is created for installations or insulating materials while saving on material, without detracting from the stability of the building module.

28 Claims, 14 Drawing Sheets

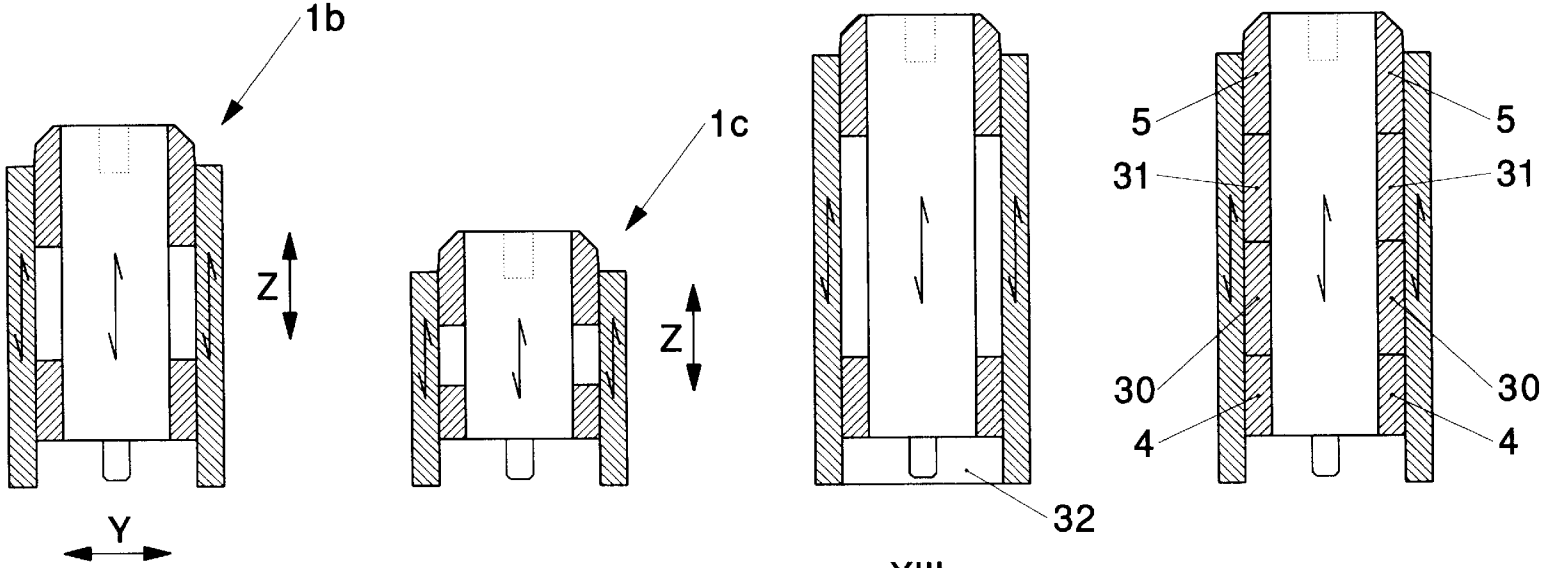
Fig. 9
Fig. 10
Fig. 13
Fig. 11
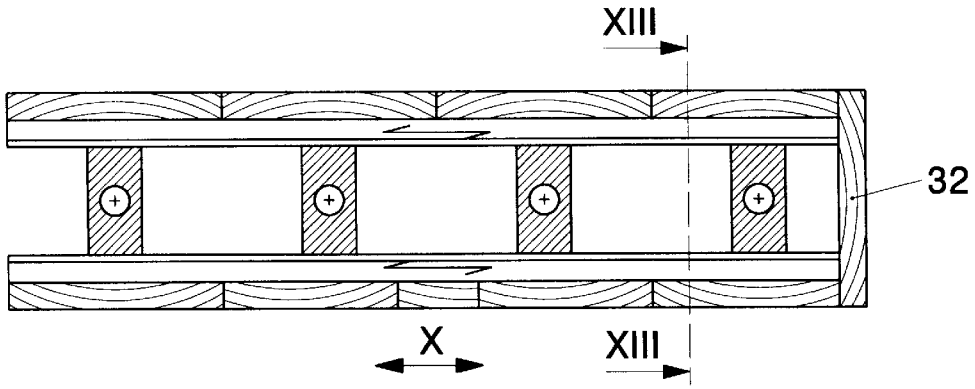
Fig. 12

BUILDING MODULE AND BUILDING MODULE SYSTEM FOR PRODUCING FLAT CONSTRUCTION, ESPECIALLY WALLS

BACKGROUND OF THE INVENTION

1. Field of the Invention

The invention relates to a building module and a building-module system for erecting flat structures, in particular walls.

2. Description of the Prior Art

A building module of this type constitutes the subject matter of European Patent Application No. 95105246.3. This patent application proposes a manageable building module which, in relation to the known building elements known, for example, from EP Patent 0 214 088, permits structures to be erected in a more straightforward manner and allows straightforward conversion with a wide range of possible configurations.

The object of the present invention is further to improve a building module of this type, and a building-module system, in order to increase further, by straight-forward design means, the wide range of possible configurations.

Pursuant to this object, and others which will become apparent hereafter, one aspect of the present invention resides in a building module for erecting flat structures, which building module comprises two parallel, plane-like wall parts which have outer surfaces that are directed away from one another, and a module-core made up of a plurality of individually produced and interconnected parts arranged between the two wall parts and fixedly connected thereto so that a space is formed between the wall parts, the mold core including at least one mold core part which runs in a longitudinal direction of the building module so as to project from the wall parts and be insertable between wall parts of a further building module so as to form, with these further wall parts, an innerlocking connection which absorbs forces in a transverse direction. The building module further includes means provided at the module-core for forming, with a module-core of a further building module, an interlocking connection which absorbs forces in the longitudinal direction.

Another aspect of the invention resides in a building-module system for erecting flat structures, which is comprised of a plurality of the building modules.

The advantages achieved by the invention can be seen, in particular, in that, with modules of the same dimensions, it is possible to cut back on the amount of material used and to gain more space for installations or insulation material without impairing the stability of the building module to any great extent.

BRIEF DESCRIPTION OF THE DRAWINGS

The invention will now be explained in more detail with reference to the drawing, in which:

FIG. 9 shows an illustration, corresponding to FIG. 8, of a reduced-height building module;

FIG. 10 shows a further illustration, corresponding to FIG. 8, of a reduced-height building module;

FIG. 11 shows an illustration, corresponding to FIG. 8, of a further building module;

FIG. 12 shows a plan view of a building module with an end-side covering;

FIG. 13 shows a section along line XIII—XIII in FIG. 12;

DETAILED DESCRIPTION OF THE PREFERRED EMBODIMENTS

Figure 1:
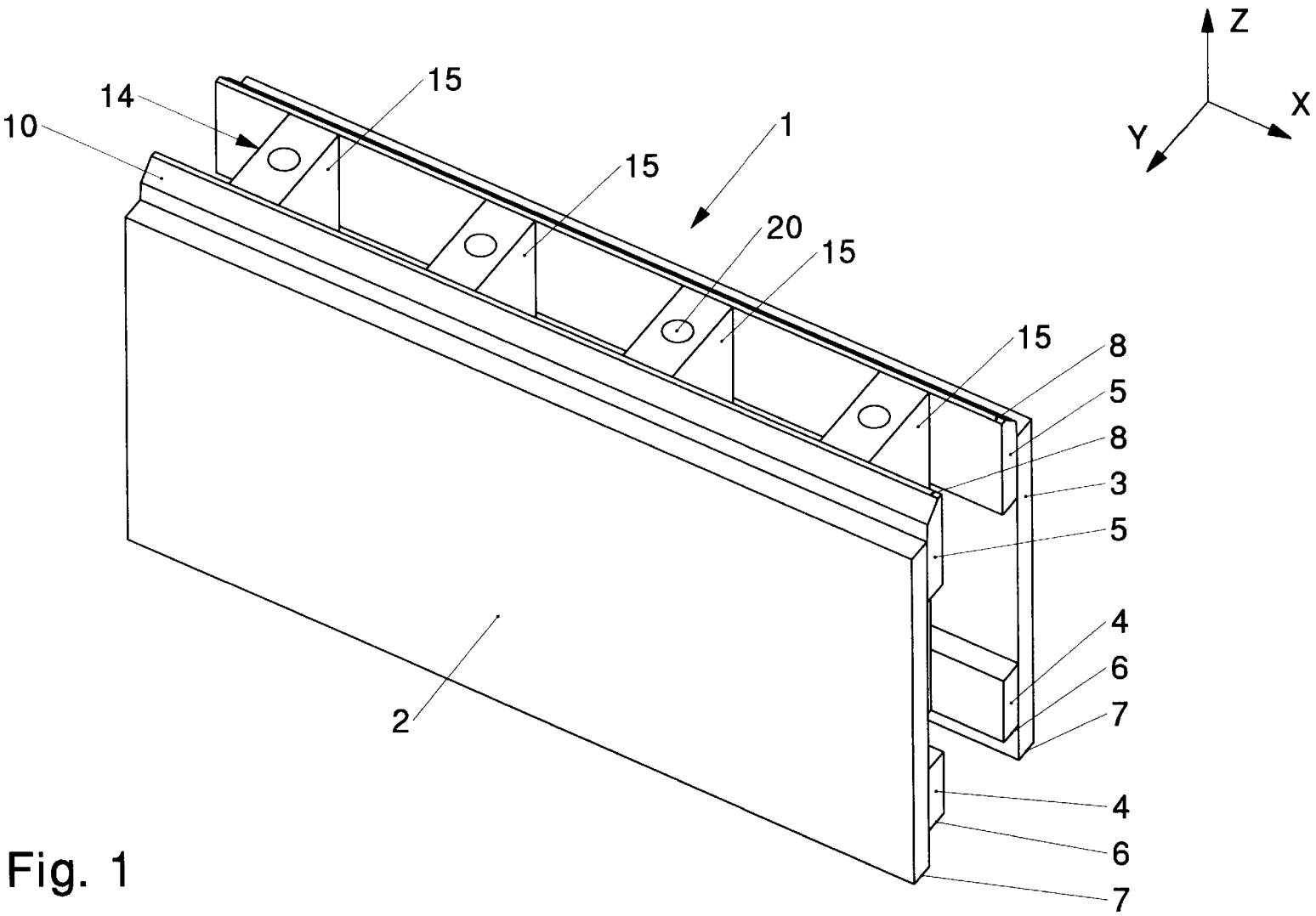
FIG. 1 shows a first exemplary embodiment of a building module in a perspective illustration as seen from above.
Figure 2:
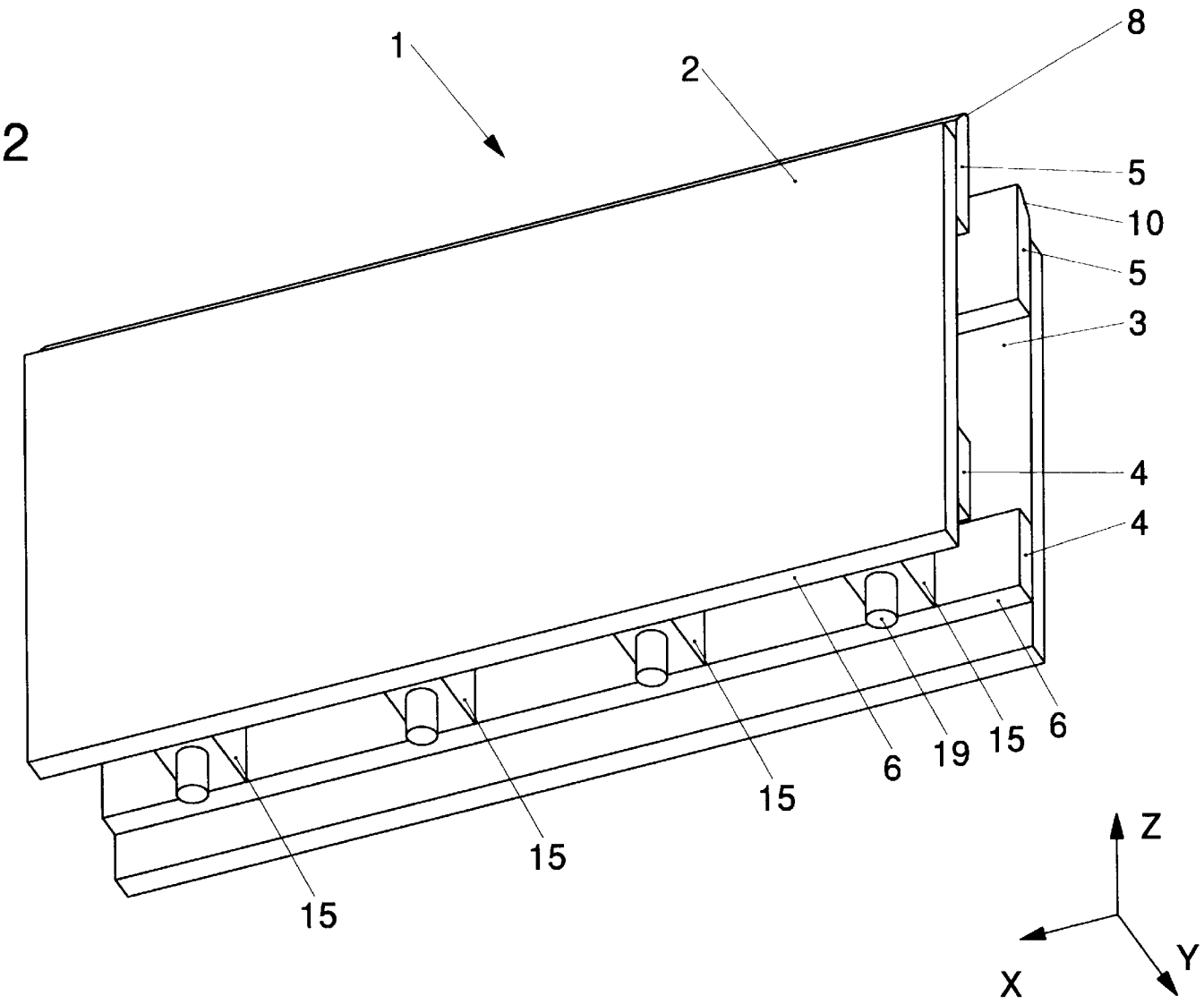
FIG. 2 shows the building module according to FIG. 1 in a perspective illustration as seen from below.

According to FIGS. 1 to 5, a building module 1 has two parallel, rectangular wall parts 2, 3 which each form part of one of the two surfaces of a wall which is to be erected. These wall parts may be wood panels, board sections, or panels made of derived timber products or other types of materials. It is also possible for one of the wall parts 2, 3, or both wall parts, to be designed as a gypsum board or to consist of other generally known materials, e.g. clay, fibrated concrete, etc. The longitudinal direction of the building module 1 is designated by X, the transverse direction is designated by Y and the vertical direction is designated by Z.

On its inside, which is directed toward the interior of the building module 1, each wall part 2, 3 is provided with a bottom strip 4, arranged in the longitudinal direction X of the building module 1, and with a top strip 5, which is oriented in the same direction. Whereas the bottom strips 4 are offset into the interior of the building module 1 in the vertical direction Z with respect to the wall parts 2, 3 (i.e. bottom surfaces 6 of the strips 4 are arranged at a higher level than bottom surfaces 7 of the wall parts 2, 3, see FIGS. 1, 2, 4 and 5), the top strips 5 project beyond the wall parts 2, 3 in the vertical direction Z (i.e. top surfaces 8 of the strips 5 are located at a higher level than top surfaces 9 of the wall parts 2, 3). In this region, the outside of the top strips 5 is provided with oblique surfaces 10, although that part of the outer surfaces of the top strips 5 which projects beyond the wall parts 2, 3 and is designated by 11 is provided for absorbing forces in the transverse direction Y, which will be described hereinbelow. However, the strips 5 could also be profiled differently and have, for example, rounded surfaces instead of the oblique surfaces 10.

Figure 3:
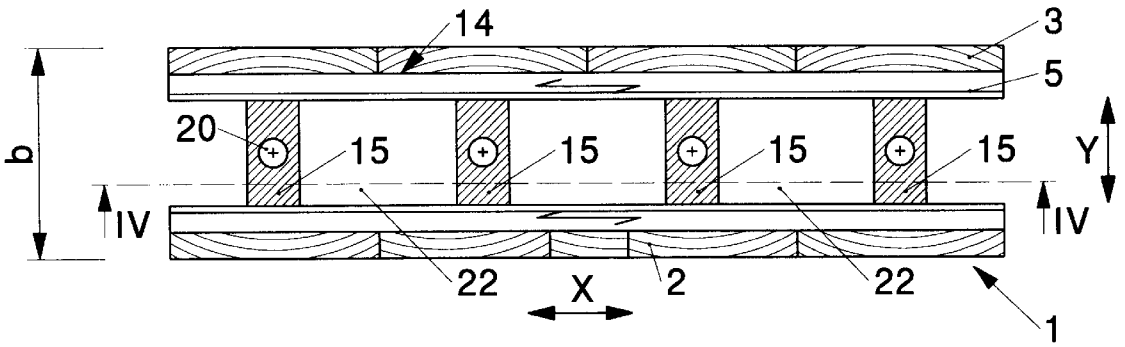
FIG. 3 shows a plan view of the building module according to FIG. 1.

The wall parts 2, 3 may either be in one piece or be made up of a plurality of sections, for example board sections, as is illustrated in FIG. 3. The connection of the wall parts 2, 3 to the wood strips 4, 5 is preferably produced by adhesive bonding, but could also take place by means of mechanical connecting means which are known in general.

In the same way, a plurality of, possibly four, vertically arranged intermediate webs 15, which are spaced apart from one another at regular intervals and are of rectangular cross section, are connected to the bottom and top strips 4, 5 of the two walls 2, 3. The intermediate webs 15 are also produced from wood and form, together with the two pairs of strips 4, 5, a module core designated by 14.

Figure 4:
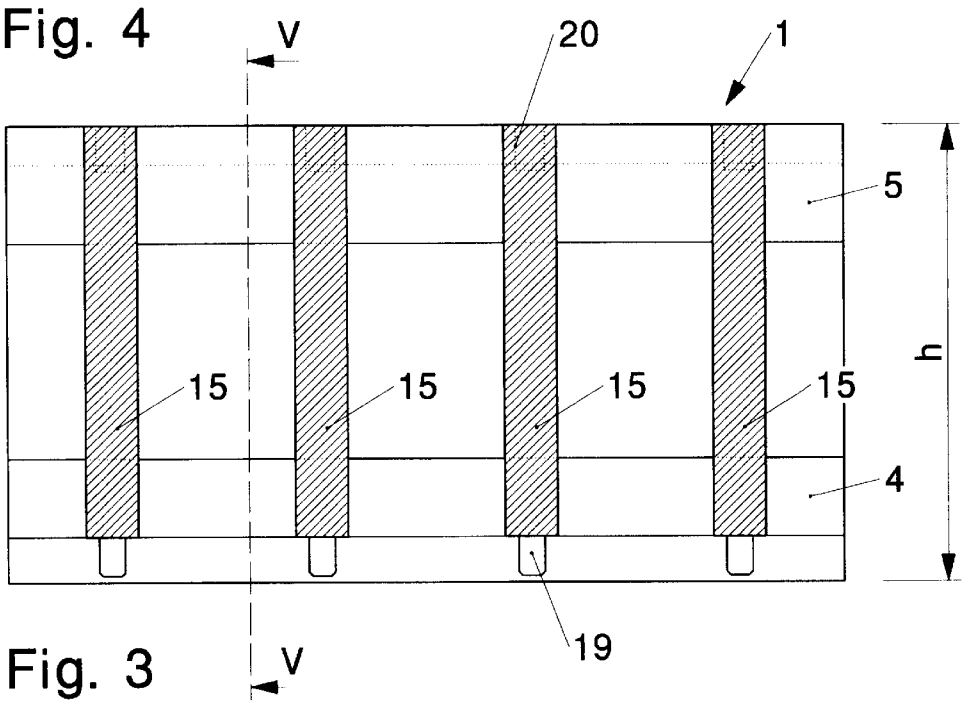
FIG. 4 shows a section along line IV—IV in FIG. 3.
Figure 5:
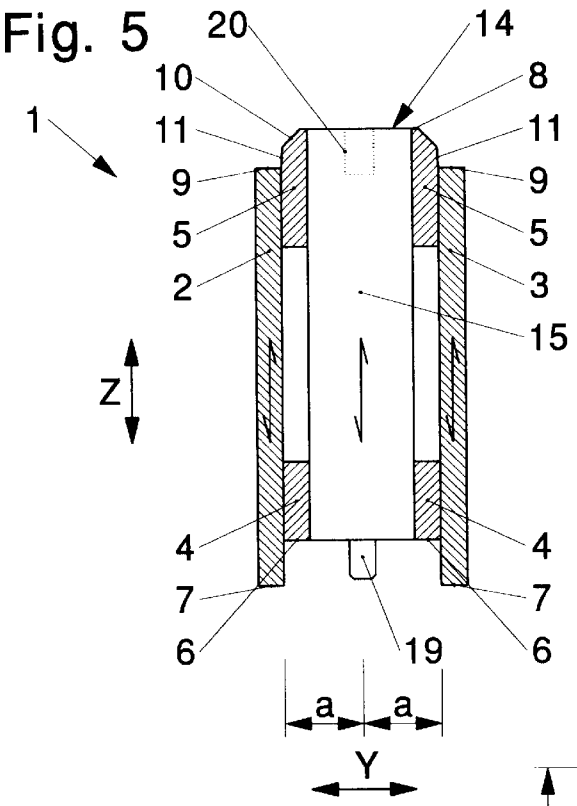
FIG. 5 shows a section along line V—V in FIG. 4.

As can be seen from FIGS. 4 and 5, bottom end surfaces 16 of the intermediate webs 15 are located in the same plane as the bottom surfaces 6 of the strips 4. These end surfaces 16 are provided with downwardly directed protrusions in the form of stubs 19 which are produced by milling, or are inserted into the intermediate webs 15, do not project beyond a plane defined by the bottom surfaces 7 of the wall parts 2, 3 and are protected by the wall parts 2, 3 against any damage, for example being broken off, by virtue of being set back into the interior of the building module 1 in this way. Top end surfaces 17 of the intermediate webs 15 are flush with top surfaces 8 of the strips 5 and have depressions 20 which mate with the stubs 19. In this embodiment, the stubs 19 (as well as the depressions 20) are located at the same distance a from the two wall parts 2, 3.

Vertical through-cavities 22 are provided between the individual intermediate webs 15.

When a further building module 1 is attached, the wall parts 2, 3 of the further building module 1 engage, by way of their bottom region, which projects beyond the actual module core 14, around the module core 14 of the bottom building module 1, said module core projecting upward beyond the wall parts 2, 3. The top surfaces 8 of the strips 5 and the top end surfaces 17 of the intermediate webs 15 of the bottom building module 1 come to rest against the bottom surfaces 6 of the strips 4 and the bottom end surfaces 16 of the attached building module, the stubs 19 passing into the depressions 20. The bottom surfaces 7 of the wall parts 2, 3 of the attached building module 1 come into contact with the top surfaces 9 of the bottom building module 1. This vertical joining achieves an interlocking connection, of the building modules 1 positioned in layers one above the other, which absorbs not just vertical forces but also forces in the two horizontal directions, i.e. both in the longitudinal direction X of the building module 1 and in the transverse direction Y thereof. It is preferable for the wall parts 2, 3 in each case to absorb most of the vertical forces. In the longitudinal direction X, the stubs 19 and the depressions 20 form the force-absorbing means; in the transverse direction Y, the forces are absorbed not just by the stubs 19 and the depressions 20 but also via the wall parts 2, 3 of the attached building module 1 and via the parts 11 of the top strips 5 which project out of the bottom building module 1. The oblique surfaces 10 of the top strips 5 make it easier to join the two building modules 1 together.

In the abovedescribed vertical joining of two building modules 1, it is also possible, if required, for the wall parts 2, 3 of the top building module 1 to be nailed from the side, in their bottom region, to the upwardly projecting module core 14 of the bottom building module 1.

The building module 1 according to the invention is a building element which can be managed by hand. It preferably has a length of from 20 to 100 cm, a width of from 6 to 36 cm and a height of from 10 to 50 cm. In the embodiment illustrated in FIGS. 1 to 5, the building modules 1 can be positioned in a row with their end sides directly one beside the other and can be interconnected vertically one above the other, it also being possible, by virtue of the symmetrical construction, for the building modules to be turned through 180° about a vertical axis. However, for positioning one above the other, the building modules are also advantageously arranged, as seen in the longitudinal direction X, so as to be offset with respect to one another by one, two or three web spacings in each case, this ensuring a form-fit connection of the building modules 1 which are adjacent in the longitudinal direction X. The cavities 22 of the building modules positioned in layers one above the other are each arranged to be in alignment with one another. The lowermost row of building modules is fastened (in a manner which is not illustrated specifically) on a base beam, which is preferably provided with a plug-in profile suitable for the underside of the building modules.

Of course, it would also be possible to achieve the vertical joining with building modules 1 which are turned through 180° about a horizontal axis.

That embodiment of a building module 1 which is illustrated in FIGS. 1 to 5 constitutes a standard module which, for specific purposes, can be modified in various ways, as is described hereinbelow.

Figure 7:
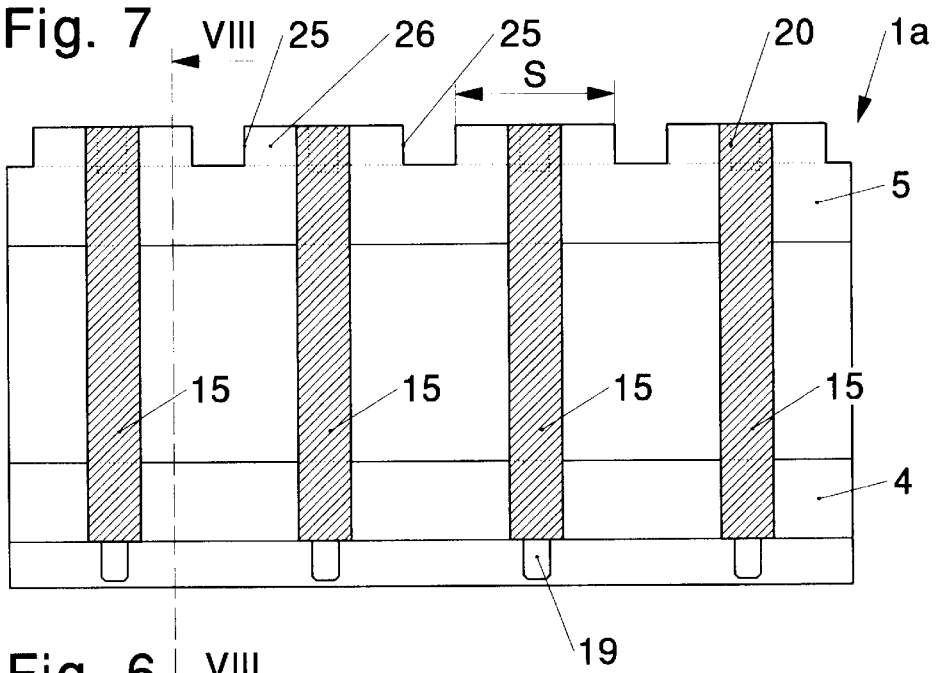
FIG. 7 shows a section along line VII—VII in FIG. 6.
Figure 6:
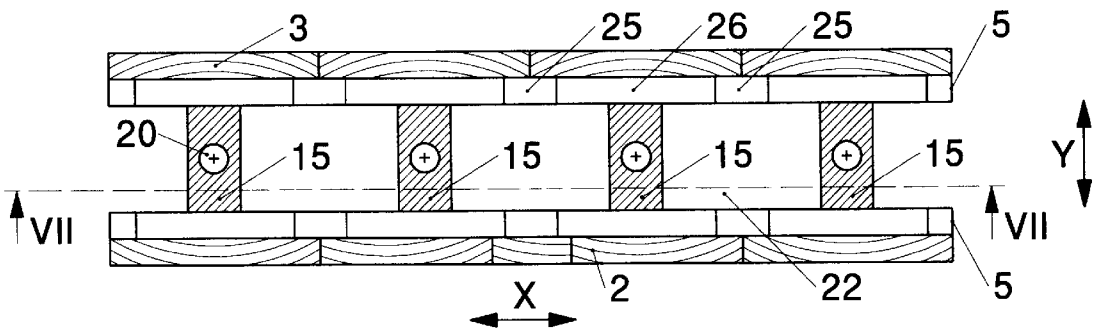
FIG. 6 shows a plan view of a second exemplary embodiment of a building module.
Figure 8:
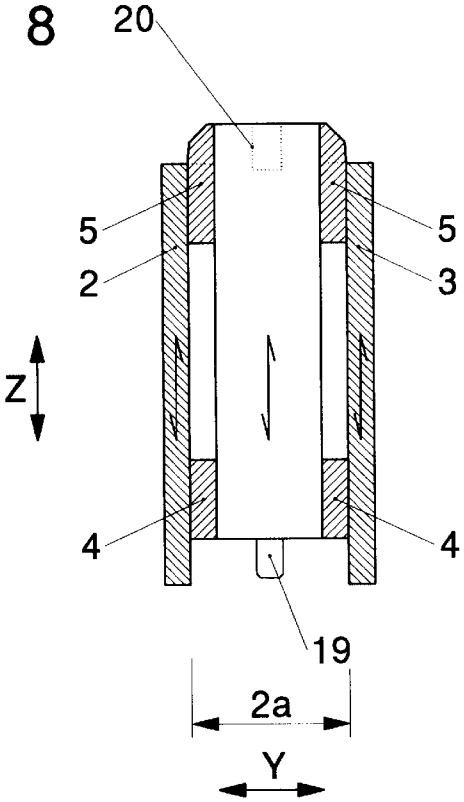
FIG. 8 shows a section along line VIII—VIII in FIG. 7.

A further embodiment of a building module 1*a* is illustrated in FIGS. 6 to 8. The similar parts with the same functions continue to be designated by the same designations as in FIGS. 1 to 5. Unlike the first variant, the top strips 5 have a plurality of cutouts 25 which run in the transverse direction Y and—as seen in the longitudinal direction X of the building module 1*a*—are each located in the center between two intermediate webs 15. In each case two cutouts 25 form a plug-in segment 26, of which the length s corresponds to the distance 2*a* between the inner walls 27, 28 of the wall elements 2, 3. There are four plug-in segments 26 in this embodiment. The plug-in segments 26 allow a further building module 1*a* to be attached to the bottom building module 1*a* at right angles. In this case, the wall parts 2, 3 of the attached building module 1*a* are inserted into the cutouts 25 assigned to one of the web segments 26. When longitudinally directed building modules 1*a* are positioned in layers one above the other, the cutouts 25 cannot be seen from the outside. Instead of providing the entire building module 1*a*, or the top strips 5 thereof, with the cutouts 25, it is, of course, also possible to provide the cutouts 25 just at the desired location.

The building modules 1, 1*a* illustrated in FIGS. 1 to 8 may also be combined with building modules 1*b* and 1*c* according to FIGS. 9 and 10, these respectively having a reduced height h' and h" in relation to a height h of the building modules 1, 1*a* (FIG. 4) and allowing the wall to be of a freely configured height.

According to FIG. 11, further strips 30, 31 may be provided between the two strips 4, 5 of the two wall parts 2, 3. This solid-surface-area design of the inner strip layer makes it possible to bridge relatively large spans, e.g. doors, windows, etc.

As can be seen from FIGS. 12 and 13, it is possible for the building modules to be fully closed off on the end sides, with the result that, in the case of corners and transverse-wall connections, there are no openings in the cover layer. An end-wall-covering end panel is designated by 32.

Figure 14:
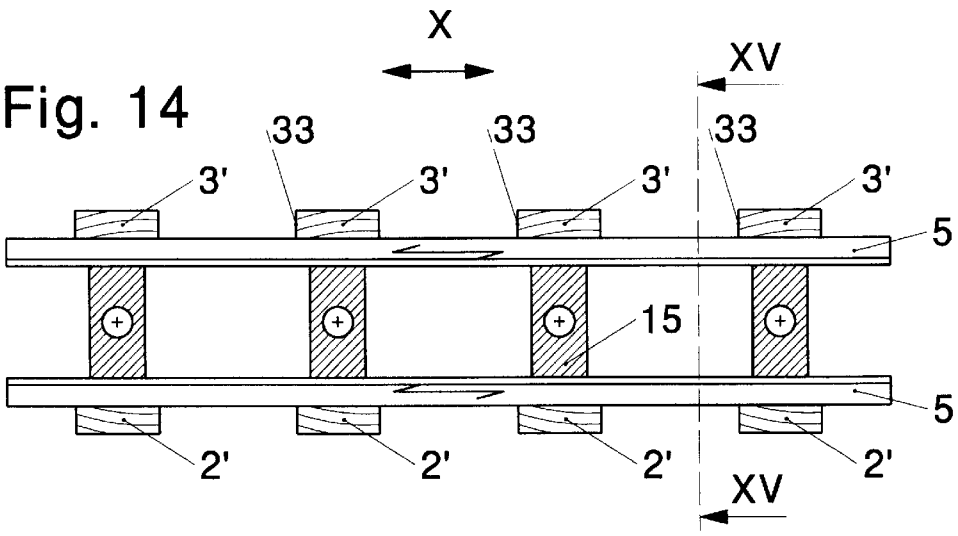
FIG. 14 shows a plan view of a further building module, which is similar to the building module shown in FIGS. 1 to 5 and has wall openings.
Figure 15:
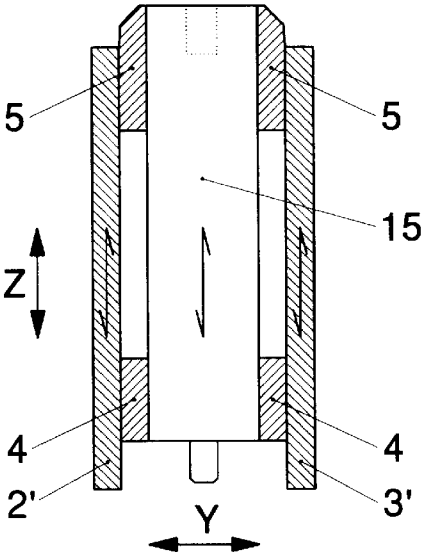
FIG. 15 shows a section along line XV—XV in FIG. 14.

In order for it to be possible to install insulating materials, installations, etc. in the wall, the wall parts 2, 3, or even just one of the two, may be provided with openings 33 at certain locations; in FIG. 14, as an example, the two wall parts 2, 3 are subdivided into four vertical wall segments 2', 3' in each case by these openings 33. However, it is also quite possible for a building module just to have a single opening 33. Of course, it is also possible for the openings 33 to be provided just in individual building modules provided for a wall. Openings of this type may also serve for the fitting of installations, for example electric sockets and switches.

Figure 16:
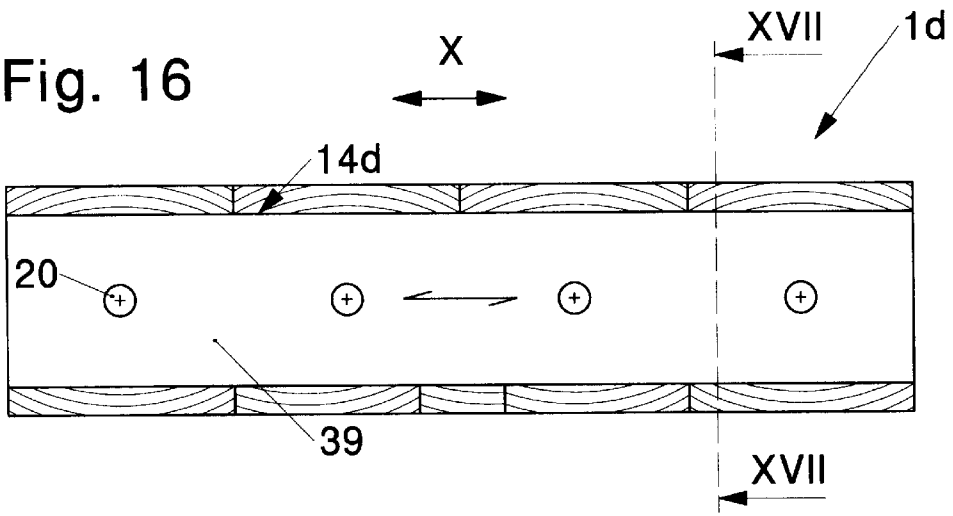
FIG. 16 shows a plan view of a building module with a wood-filled core.
Figure 17:
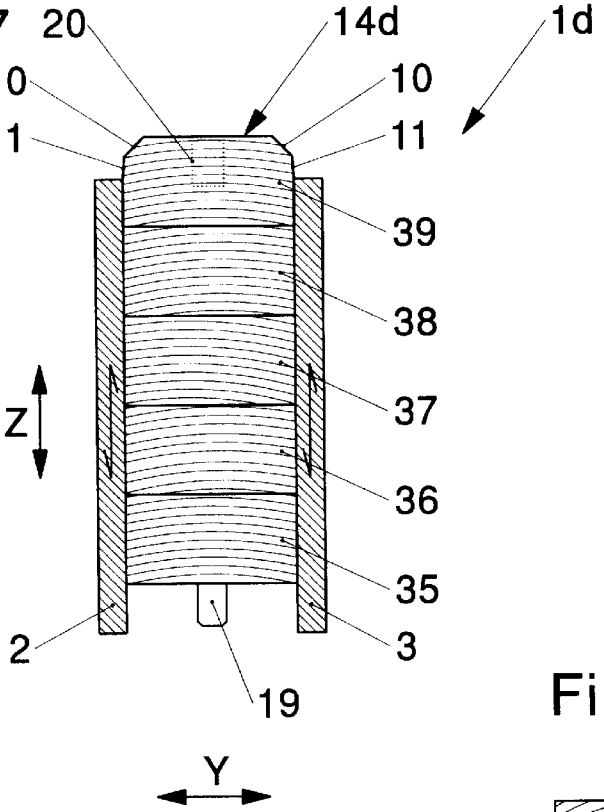
FIG. 17 shows a section along line XVII—XVII in FIG. 16.

In the embodiment of a building element 1*d* which is illustrated in FIGS. 16 and 17, the space between the wall parts 2, 3 is filled entirely with wood. According to FIG. 17, a module core 14*d* has a plurality of, possibly five, wood layers 35 to 39 which are arranged one above the other and of which the lowermost wood layer 35 is offset in the vertical direction Z with respect to the wall parts 2, 3, in the same way as the bottom strips 4 and intermediate webs 15 of the preceding exemplary embodiments, and has the stubs 19. The uppermost wood layer 39 projects beyond the wall parts 2, 3 at the top and has the oblique surfaces 10, the outer-surface parts 11, which absorb the forces in the transverse direction Y, and the depressions 20. Of course, it would also be possible for the number of wood layers used to differ from that illustrated in FIG. 17. Building elements 1*d* of this type can be used in the case of large openings, for example in the case of windows, as lintel elements, as a suspender beam or as a bearing for large single loads.

Figure 18:
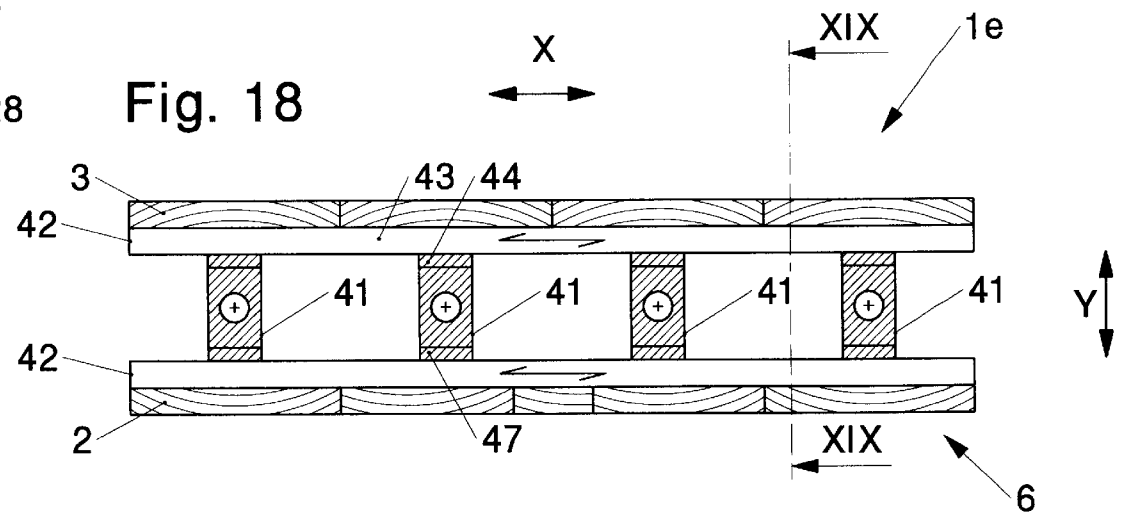
FIG. 18 shows a plan view of a further exemplary embodiment of a building module.
Figure 19:
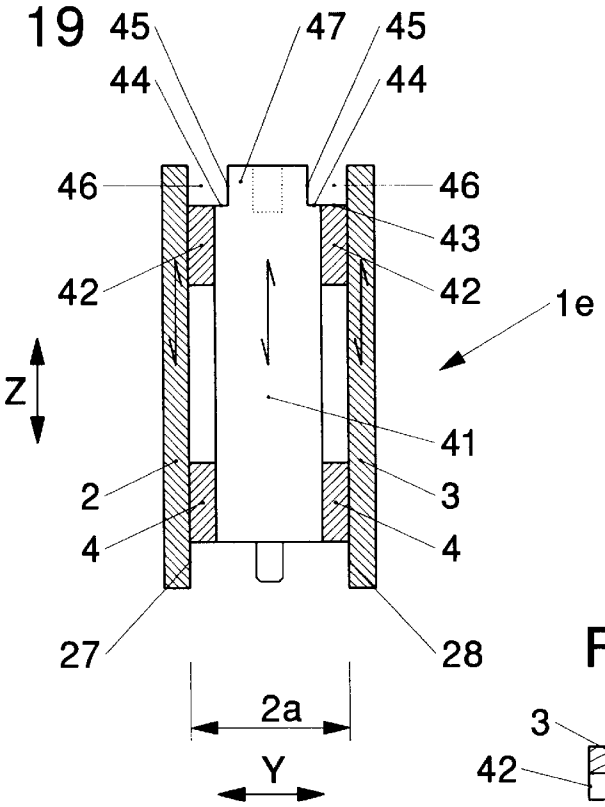
FIG. 19 shows a section along line XIX—XIX in FIG. 18.

The building module 1*e* according to FIGS. 18 and 19 is provided for receiving a cover element (not illustrated in the drawing) which closes off the wall at the top. In this embodiment, the top strips 42 are also set back into the interior of the building module 1*e*. The intermediate webs 41 are stepped in the top region, their horizontal step surfaces 44 being flush with the top surfaces 43 of the strips 42. A gap 46 for receiving the cover element, or its wall parts, is formed in each case by the respective wall part 2 or 3, the horizontal surfaces 43, 44 and vertical step surfaces 45 of the intermediate webs 41. The depressions 20 are provided for corresponding stubs of the cover element.

In all the building modules described above, it is advantageous if the ratio of building-module length to building-module width is a whole number, for example between 2 and 8, preferably 4.

Figure 20:
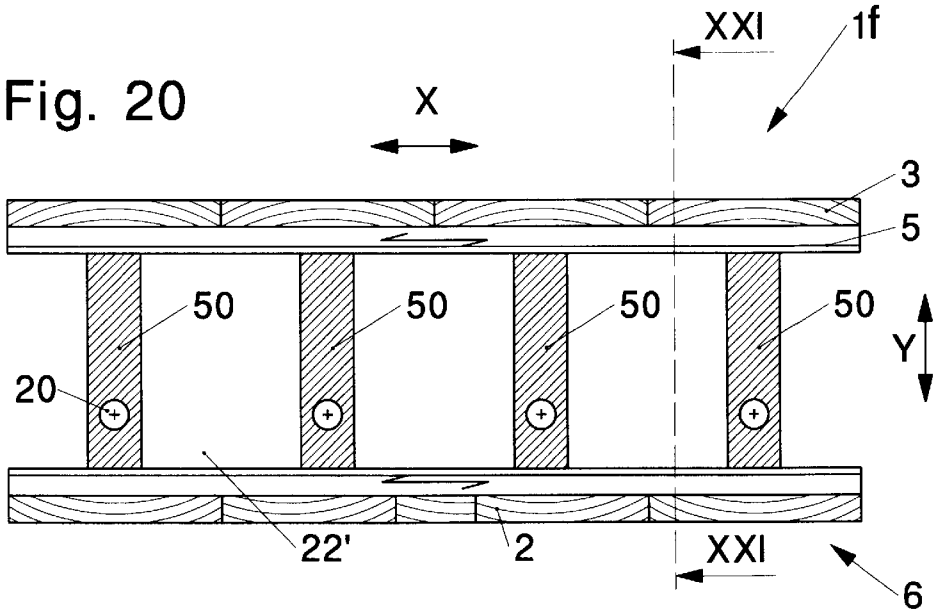
FIG. 20 shows a plan view of a further building module, which is of a width which is increased with respect to the building module according to FIGS. 3 to 5.
Figure 21:
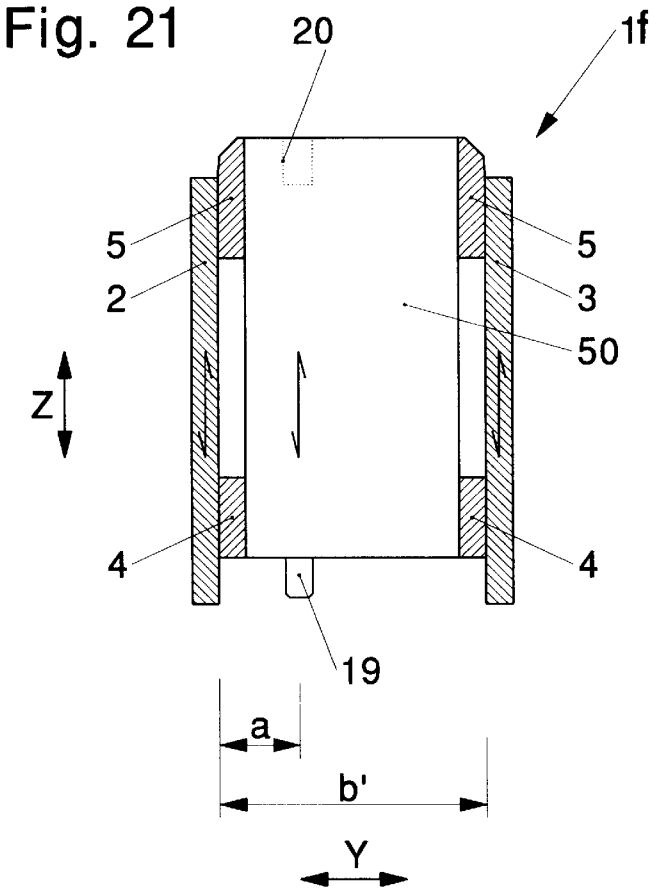
FIG. 21 shows a section along line XXI—XXI in FIG. 20.

FIGS. 20 and 21 show a building module 1*f* which is of a width b' which is increased with respect to the standard building module (building module 1) or the width b thereof (FIG. 3). The increase in the size of the cavities 22' provided for the heat and/or sound insulation can increase the resistance of the wall to heat and/or sound transmission. The wider intermediate webs are designated by 50. The stubs 19 and depressions 20 provided as interlocking-connection means with a form fit in the transverse direction are located at the same distance a from the wall part 2, which forms the outer surface of the wall which is to be erected, as in the case of a standard module (building module 1). This means that it is also possible for the building module 1*f* to be attached to a standard module. Should, on the other hand, a standard module be attached to the building module 1*f*, then that part of the standard-building-module wall part 3 which projects downward beyond the module core 14 would have to be removed.

Figure 22:
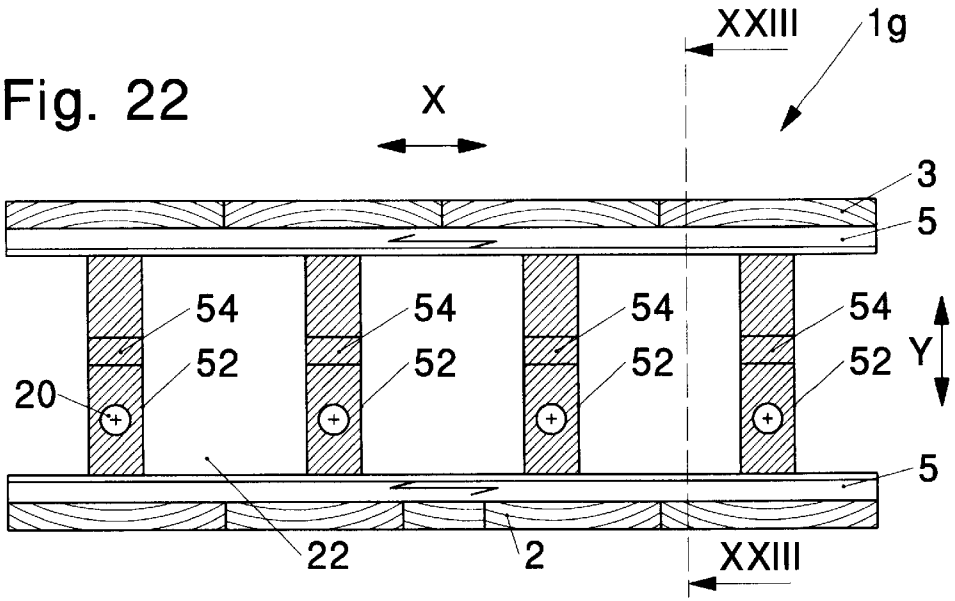
FIG. 22 shows a further variant of a building module which is of a width which is increased with respect to the building module according to FIGS. 3 to 5, and is compatible with one of the building modules according to FIGS. 1 to 19.
Figure 23:
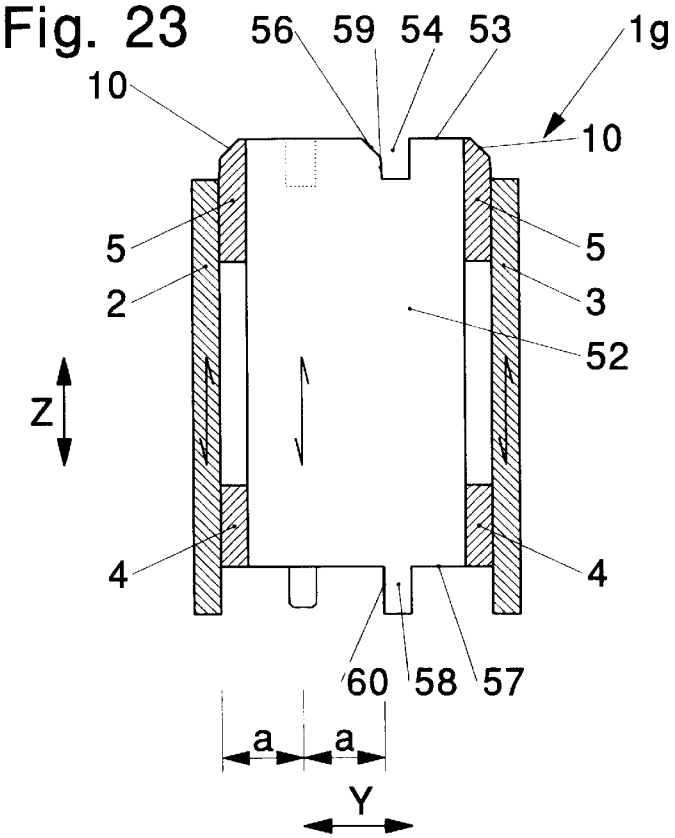
FIG. 23 shows a section along line XXIII—XXIII in FIG. 22.

In the case of the variant of a building module 1*g*, which is illustrated in FIGS. 22 and 23, the top end surfaces 53 of the intermediate webs 52, which correspond in width to the intermediate webs 50 from FIGS. 20 and 21, are each additionally provided with a longitudinal groove 54, which runs in the longitudinal direction X and of which the base 55 is located in the same plane as the top surfaces 8 of the wall parts 2, 3. The bottom end surfaces 57 of the intermediate webs 52 each have longitudinal ridges 58, which are located vertically opposite the longitudinal grooves 54. The width of the longitudinal grooves 54 and of the longitudinal ridges 58 corresponds to the thickness of the wall parts 2, 3. The distance 2*a* of the wall part 2 from the side surfaces 59 and 60 of the longitudinal grooves 54 and of the longitudinal ridges 58, respectively, corresponds to the distance 2*a* between the wall parts 2, 3 of the standard module (building module 1). In the case of this variant, it is possible for the wider building module 1*g* to be joined together on both sides, as seen in the vertical direction Z, with in each case one standard module. Of course, it is also possible for two or more building modules 1*g* to be positioned in layers one above the other, the longitudinal-groove/longitudinal-ridge connection additionally reinforcing the interlocking connection which absorbs the forces in the transverse direction Y. Together with the oblique surfaces 10 of the top strips 5, the oblique surfaces 56 of the recesses 54 make it easier to attach the building module 1*g*. The interlocking connection which absorbs the forces in the longitudinal direction X (stubs 19, depressions 20) is configured in the same way as in the case of the above-described building module 1*f*. In both cases, the wall formed by wall parts 2 remains stepless.

Figure 24:
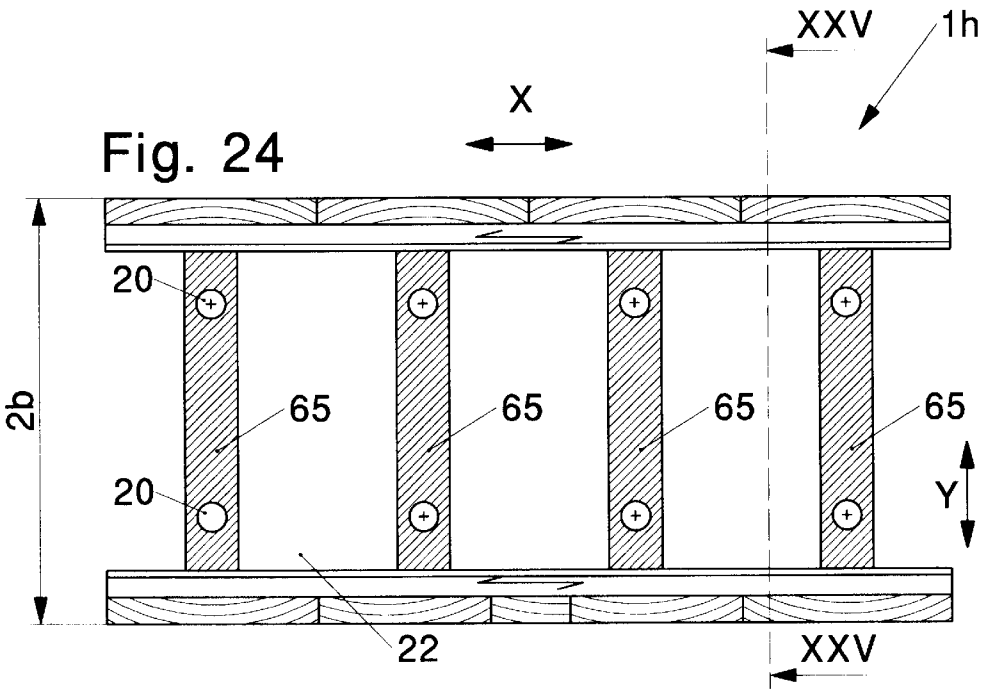
FIG. 24 shows a plan view of a building module which is of a width which is double that of the building module according to FIGS. 3 to 5.
Figure 25:
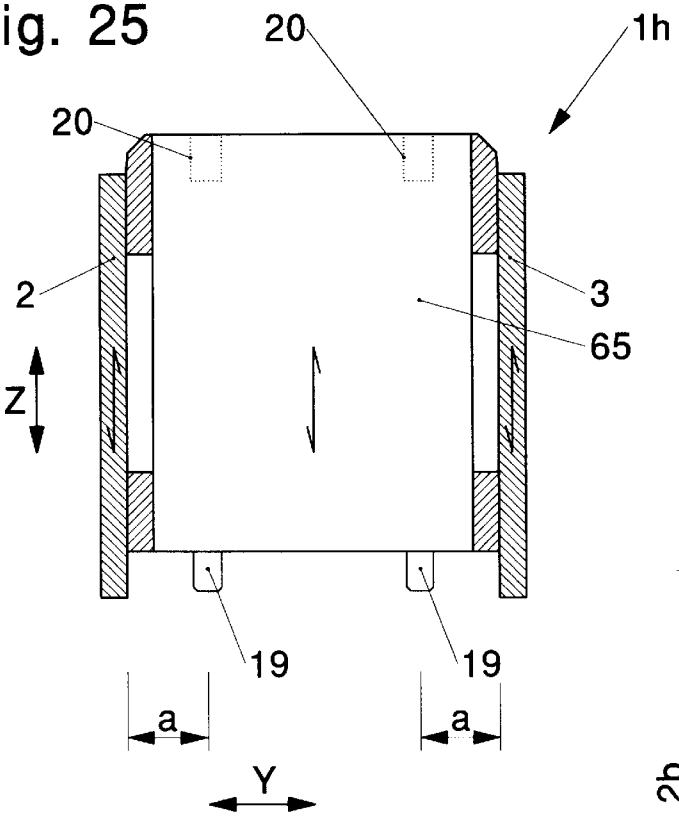
FIG. 25 shows a section along line XXV—XXV in FIG. 24.
Figure 26:
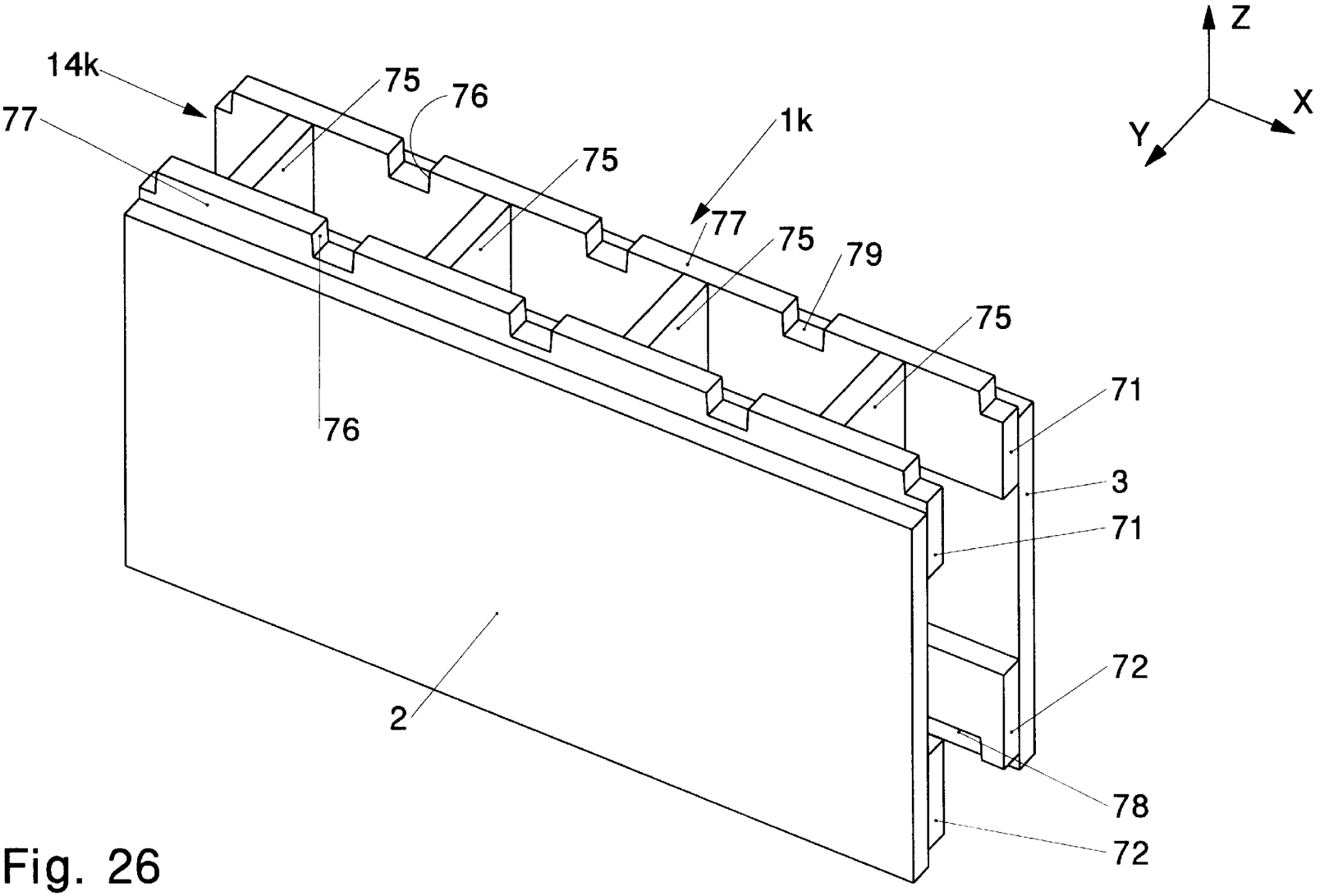
FIG. 26 shows a further exemplary embodiment of a building module in a perspective illustration as seen from above.
Figure 27:
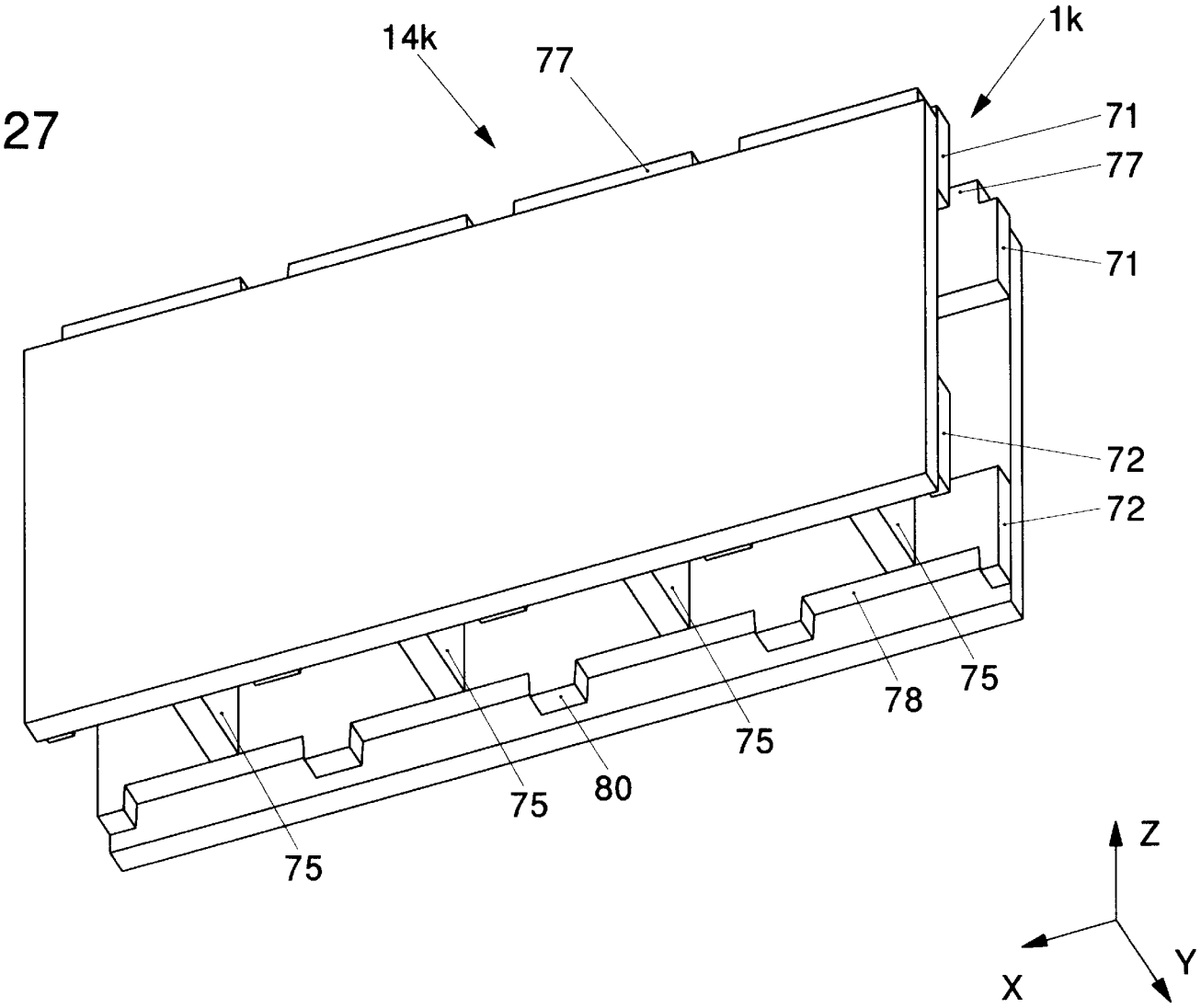
FIG. 27 shows the building module according to FIG. 26 in a perspective illustration as seen from below.
Figure 29:
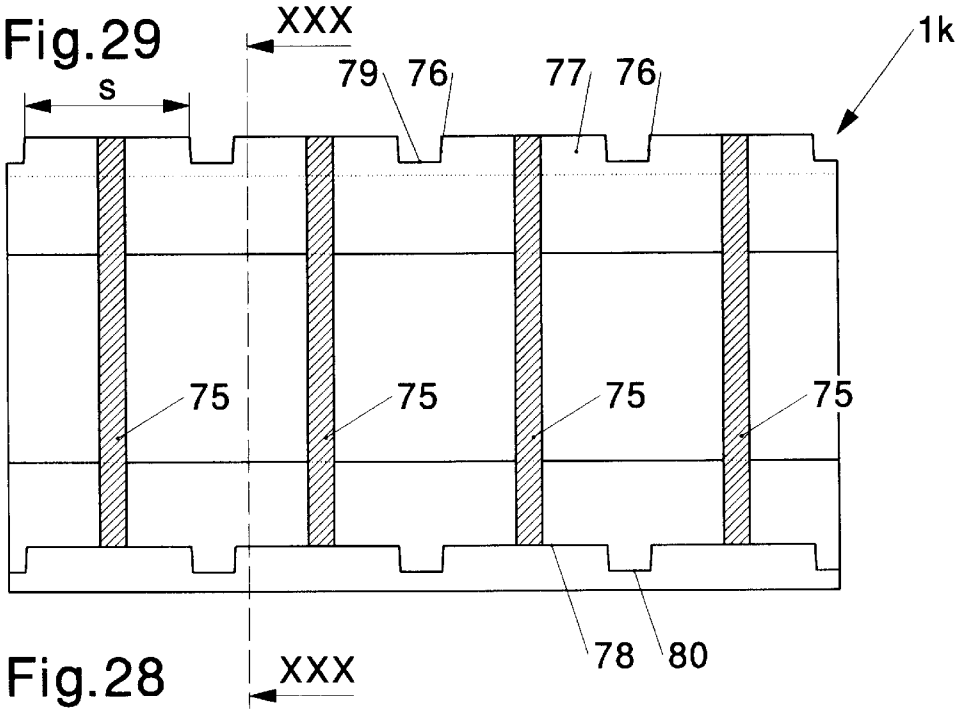
FIG. 29 shows a section along line XXIX—XXIX in FIG. 28.
Figure 28:
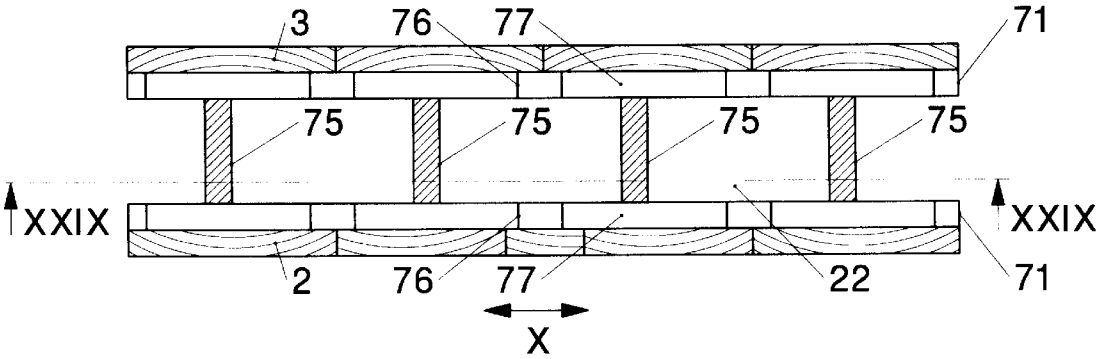
FIG. 28 shows a plan view of the building module according to FIG. 26.
Figure 30:
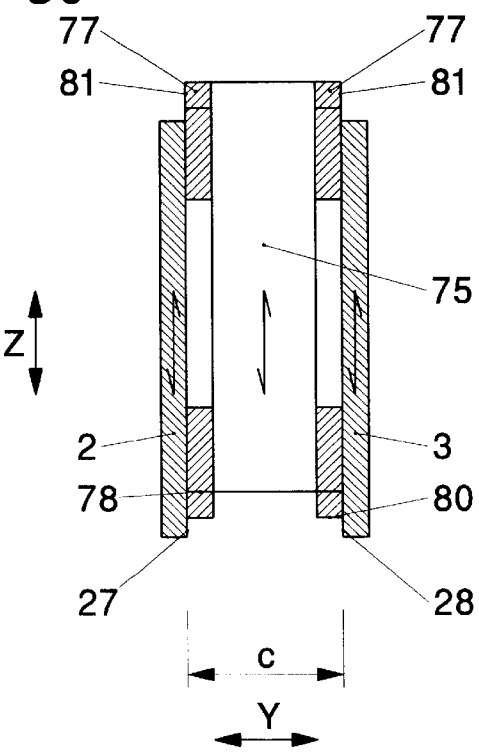
FIG. 30 shows a section along line XXX—XXX in FIG. 29.

According to FIGS. 24 and 25, building modules 1*h*, for increasing the resistance to heat and/or sound transmission, may also be of a width 2*b* which is double that of the standard module, in each case two stubs 19 and in each case two depressions 20 expediently being assigned to each intermediate web 65 in this embodiment. The stubs 19 and the depressions 20 are located at the same distance a from the respective wall part 2 or 3 as in the case of a standard module.

In all the abovedescribed embodiments of the module cores, the stubs 19 (as well as the longitudinal ridges 58 of the building module 1*g* according to FIGS. 22 and 23) are protected, by the projecting part of the walls 2, 3, against any damage, for example being broken off.

FIGS. 26 to 30 illustrate a further embodiment of a building module 1*k*. Fastened, once again, on the inside of the wall parts 2, 3 are in each case two laths or strips 71, 72, which are arranged in a manner corresponding to the strips 4, 5, are connected to one another via intermediate webs 75 in the manner described above and, together with these webs, form a module core 14*k*. The top strips 71 have cutouts 76 which are spaced apart at regular intervals at the top, run in the transverse direction Y and form a plurality of, possibly four, plug-in segments 77, which project beyond the wall parts 2, 3. The bottom strips 72 are provided on the underside with mating plug-in grooves 78, which are arranged opposite the plug-in segments 77. The intermediate webs 75 are vertically flush with the plug-in segments 77 and the plug-in grooves 78 and—as seen in the longitudinal direction X of the building module 1*k*—are each arranged in the center thereof. Whereas the base 79 of the cutouts 76 is advantageously located at a somewhat higher level than the top surfaces 9 of the wall parts 2, 3, the bottom surfaces 80, which are interrupted by the plug-in grooves 78, are offset upward by the same extent with respect to the bottom surfaces 7 of the wall parts 2, 3. However, it would also be possible for both the base 79 of the cutouts 76 and the surfaces 80 to be in alignment with the wall parts 2, 3. In this embodiment too, it is advantageous for the length s of the plug-in segments 77 to correspond to the distance c between the inner walls 27, 28 of the wall elements 2, 3 (FIGS. 29 and 30), with the result that it is also possible for the building modules 1*k* to be positioned one above the other at right angles. Once again, in the longitudinal direction X, it is possible for the building modules 1*k* to be positioned in layers one above the other in a state in which they are offset with respect to one another by one, two or three cutout spacings. In this variant, the plug-in segments 77 and the plug-in grooves 78 form, for the modules 1*k* which are positioned in layers one above the other, the interlocking connection which absorbs the forces in the longitudinal direction X. An interlocking connection which absorbs the forces in the transverse direction Y is formed by the outer surfaces 81 of the top strips 71, said outer surfaces projecting beyond the wall parts 2, 3, and the inner surfaces 27, 28 of the wall parts 2, 3 of the attached building module 1*k*. It is also the case in this variant of an interlocking connection for the vertical joining of building modules 1*k* which are positioned in layers one above the other that the wall parts 2, 3 absorb at least most, if not all, of the vertical forces.

It would also be possible for this embodiment to serve as a standard building module and to be modified for specific purposes similarly to the building module 1 (for example further strips arranged so as to fill the surface area between the strips 71, 72, wall parts 2, 3 provided with openings, building modules of various heights is combined, etc.). It is advantageous in the case of this variant too, if the ratio of building-module length to building-module width is a whole number, for example between 2 and 8, preferably 4.

All of the abovedescribed building-module variants are stable, warp-resistant building modules which make it possible, in a straightforward manner, to build load-bearing structures, in particular walls, by hand without additional transverse connecting means and in the "dry" state—i.e. without additional bonding and sealing agents. In this case, the building modules and/or module cores according to the invention—with the exception of the building module 1*d* according to FIGS. 16 and 17, which is provided for special purposes—constitute a solution which cuts back on a large amount of material but does not impair the stability of the building modules. In the case of these building-module variants, the cavities provided in building modules which are positioned in layers one above the other, said cavities being in alignment with one another in the vertical direction, have a large capacity and provide a large amount of space for installation lines or insulation material. Subsequent conversion or additions to the installation network can also easily be carried out. A fundamental advantage is that it is possible to combine different types of building module with one another as desired, as has been described above. Since a standard building module is compatible with a multiplicity of specially designed building modules—as has been described above—this makes available a building-module system which, in a straightforward manner, permits a wide range of possible configurations for the purpose of erecting walls.

Although the module cores are preferably produced from wood, it would also be possible to produce at least individual module-core parts from other materials, for example metal.

The grain direction in the wood preferably runs in the vertical direction in the wall elements 2, 3 and in the intermediate webs 15, 41, 50, 52, 65, whereas a horizontal grain direction is preferred in the strips 4, 5, 71, 72 or in the wood layers 35 to 39.

Using wood as the building material makes it possible to erect cost-effective, comfortable and ecologically sound structures.

What is claimed is:

1. A building module for erecting flat structures, comprising:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction substantially over an entire length of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction.

2. The building module as in claim 1, wherein the module-core includes two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts.

3. The building module as in claim 2, wherein the pair of strips that projects beyond the wall elements is at a top end of the wall parts.

4. The building module as in claim 2, wherein the means for forming the interlocking connection which acts in the longitudinal direction are arranged at end sides of the intermediate webs and include stubs and mating depressions in the webs.

5. The building module as in claim 4, wherein top end sides of the intermediate webs are located in a common plane with top surfaces of the top pair of strips and bottom end sides of the intermediate webs are arranged in a common plane with bottom surfaces of the bottom pair of strips, the stubs being provided at the bottom end sides of the intermediate webs and depressions being provided at the top end sides of the intermediate webs.

6. The building module as in claim 4, wherein the stubs and the mating depressions are arranged at an equal distance from the two wall parts.

7. The building module as in claim 4, wherein the intermediate webs each have two stubs, which are located at an equal distance from a respective one of the wall parts, and two corresponding mating depressions.

8. The building module as in claim 4, wherein the intermediate webs have one end side provided with a longitudinal groove and an opposite end side provided with a longitudinal ridge that corresponds with the longitudinal groove, the stubs and the depressions, as seen in the transverse direction, each being centered between one of the wall parts and the longitudinal groove and the longitudinal ridge, respectively.

9. The building module as in claim 8, wherein the longitudinal groove and the longitudinal ridge have a width that corresponds to a thickness of the wall parts.

10. The building module as in claim 3, wherein the means for forming the interlocking connection which acts in the longitudinal direction are assigned to top surfaces of the top pair of strips and to bottom surfaces of the bottom pair of strips.

11. The building module as in claim 2, wherein the intermediate webs are arranged to subdivide the space between the wall parts into a plurality of cavities which pass through vertically so as to be in alignment with corresponding cavities of an attached building module.

12. The building module as in claim 2, wherein one pair of the strips arranged horizontally opposite one another has at least in each case two cutouts which are arranged symmetrically with respect to at least one of the intermediate webs run in the transverse direction and form in each case one plug-in segment having a width, as seen in the longitudinal direction of the building module, that corresponds to a distance between the two wall parts, so as to permit attachment of a further building module at a right angle.

13. The building module as in claim 10, wherein one pair of the strips has a plurality of plug-in segments and the other pair of the strips has substantially mating plug-in grooves for forming the interlocking connection which acts in the longitudinal direction.

14. The building module as in claim 12, wherein one pair of the strips has a plurality of plug-in segments and the other pair of the strips has substantially mating plug-in grooves for forming the interlocking connection which acts in the longitudinal direction.

15. The building module as in claim 3, and further comprising strips arranged so as to fill the surface area between the top strips and the bottom strips.

16. The building module as in claim 11, wherein the wall parts have openings which render the cavities accessible.

17. The building module as in claim 1, and further comprising an end panel mounted to the wall parts so as to close off an end surface of the building module.

18. The building module as in claim 1, wherein the module-core includes a plurality of stacked wood layers which run in the longitudinal direction, an uppermost wood layer forming one end side of the module-core and projecting beyond the wall elements in the vertical direction so as to form the module-core part which, when a further building module is attached, absorbs the transverse forces in the transverse direction, a lowermost wood layer forming the other end side of the module-core and being offset into the interior of the building module with respect to the wall elements.

19. The building module as in claim 18, wherein the means for forming the interlocking connection which acts in the longitudinal direction are assigned to the uppermost and the lowermost wood layers and include a plurality of stubs which are distributed at regular intervals over the building-module length, and corresponding depressions.

20. A building-module system for erecting flat structures, comprising:

a standard building module comprising:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the means for forming the interlocking connection which acts in the longitudinal direction being arranged at end sides of the intermediate webs and include stubs and mating depressions in the webs, the stubs and the mating depressions being arranged at an equal distance from the two wall parts; and a further building module joined to the standard building module in the vertical direction so that an interlocking connection with a form fit in the transverse direction results.

21. The building module system as in claim 20, wherein the standard building module has a height and the further building module has a lower height so that the flat structure can have a freely configured height.

22. The building module system as in claim 20, wherein the further building module is a standard building module.

23. The building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the means for forming the interlocking connection which acts in the longitudinal direction being arranged at end sides of the intermediate webs and, include stubs and mating depressions in the webs, the intermediate webs each having two stubs which are located at an equal distance from a respective one of the wall parts, and two corresponding mating depressions.

24. A building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the intermediate webs being arranged to subdivide the space between the wall parts into a plurality of cavities which pass through vertically so as to be in alignment with corresponding cavities of an attached building module.

25. A building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the pair of strips that projects beyond the wall elements being at a top end of the wall parts, the means for forming the interlocking connection which acts in the longitudinal direction being assigned to top surfaces of the top pair of strips and to bottom surfaces of the bottom pair of strips, one pair of the strips having a plurality of plug-in segments and the other pair of the strips having substantially mating plug-in grooves for forming the interlocking connection which acts in the longitudinal direction.

26. A building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction;

means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the pair of strips that projects beyond the wall elements being at a top end of the wall parts; and strips arranged so as to fill the surface area between the top strips and the bottom strips.

27. A building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including two strips fastened to each of the wall parts in the longitudinal direction of the building module so as to form pairs of strips with the strips of the opposing wall part, and a plurality of vertically arranged intermediate webs which are spaced apart in the longitudinal direction and connect the two pairs of strips, one of the pairs of strips being arranged to project beyond the wall parts in a vertical direction so as to form a core part which, when a further building module is attached, absorbs the transverse forces in the transverse direction, the other pair of strips being offset into the interior of the building module with respect to the wall parts, the intermediate webs being arranged to subdivide the space between the wall parts into a plurality of cavities which pass through vertically so as to be in alignment with corresponding cavities of an attached building module, the wall parts having openings which render the cavities accessible.

28. A building module system as in claim 20, wherein the further building module comprises:

two parallel, panel-like wall parts which have outer surfaces that are directed away from one another;

a module-core made up of a plurality of individually produced and interconnected parts arranged between the two wall parts and fixedly connected thereto so that a space is formed between the wall parts, the module-core including at least one module-core part which runs in a longitudinal direction of the building module so as to project from the wall parts and be insertable between wall parts of a further building module so as to form with these wall parts an interlocking connection which absorbs forces in a transverse direction; and means provided at the module-core for forming, with a module-core of a further building module, an interlocking connection which absorbs forces in the longitudinal direction, the module-core including a plurality of stacked wood layers which run in the longitudinal direction, an uppermost wood layer forming one end side of the module-core and projecting beyond the wall elements in the vertical direction so as to form the module-core part which, when a further building module is attached, absorbs the transverse forces in the transverse direction, a lowermost wood layer forming the other end side of the module-core and being offset into the interior of the building module with respect to the wall elements.

* * * * *